US006889027B2

(12) United States Patent
Tachiki et al.

(10) Patent No.: US 6,889,027 B2
(45) Date of Patent: May 3, 2005

(54) MULTICOLORED IMAGE FORMING APPARATUS FOR FORMING MULTICOLORED AND MONOCHROMATIC IMAGES

(75) Inventors: Hiroshi Tachiki, Yamatokoriyama (JP); Toshio Yamanaka, Yao (JP); Masashi Hirai, Katano (JP); Kouichi Yamauchi, Yamatokoriyama (JP); Fumio Shimazu, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 18 days.

(21) Appl. No.: 10/357,410

(22) Filed: Feb. 4, 2003

(65) Prior Publication Data

US 2003/0156864 A1 Aug. 21, 2003

(30) Foreign Application Priority Data

Feb. 15, 2002 (JP) ..... 2002-038750

(51) Int. Cl.[7] ..... G03G 15/01; G03G 15/16
(52) U.S. Cl. ..... 399/297; 399/299; 399/303
(58) Field of Search ..... 399/297, 298, 399/299, 303, 101

(56) References Cited

U.S. PATENT DOCUMENTS 5,765,082 A * 6/1998 Numazu et al. ..... 399/299
6,029,023 A * 2/2000 Munemori et al. ..... 399/299 X
6,061,542 A * 5/2000 Minami et al. ..... 399/299
6,356,732 B1 * 3/2002 Watanabe et al. ..... 399/299
6,385,427 B1 * 5/2002 Nakane ..... 399/303
6,636,711 B1 * 10/2003 Katahira ..... 399/299 X

FOREIGN PATENT DOCUMENTS

JP 2000-322098 A 11/2000

* cited by examiner

*Primary Examiner*—William J. Royer
(74) *Attorney, Agent, or Firm*—Birch, Stewart, Kolasch & Birch, LLP

(57) ABSTRACT

A junction/disjunction unit of a multicolored image forming apparatus joints/disjoints a transfer material holder with/from an image holder, to switch over between a monochromatic image forming mode which uses a specific image forming unit and a multicolored image forming mode which uses a plurality of image forming units. For switching the image forming mode, a driving unit for driving the junction/disjunction unit also drives an auger provided for conveying toner, which has been recovered by a transfer material holder cleaning unit for recovering toner remaining on the transfer material holder, into a recovery container. Accordingly, a driving force outputted from the driving unit can be effectively utilized, and thereby good cost performance can be realized.

20 Claims, 5 Drawing Sheets

MULTICOLORED IMAGE FORMING APPARATUS FOR FORMING MULTICOLORED AND MONOCHROMATIC IMAGES

BACKGROUND OF THE INVENTION

1. Field of the Invention

The present invention relates to a multicolored image forming apparatus, such as a copying machine, a facsimile machine and a printer, which can form a multicolored image and a monochromatic image on a recording material.

2. Description of Related Art

Widely used conventional multicolored image forming apparatus is of tandem type, which includes, for the sake of speed up of image output, four image forming units arranged in parallel with each other along a direction in which a recording material is conveyed, each of the four image forming units having an image holder on which electrostatic latent images are formed in correspondence with images having colors, such as cyan (C), magenta (M), yellow (Y) and black (K), peculiar to each image forming unit. With such a multicolored image forming apparatus, a multicolored image can be formed on the recording material by guiding the recording material through each image forming unit only one time.

Such a multicolored image forming apparatus is constructed to form a monochromatic image, in particular, a black-and-white image requiring only black developer, in addition to a multicolored image. Actually, in regard to a multicolored image forming apparatus capable of both multicolored image forming and black-and-white image forming, the black-and-white image forming is generally performed more often than the multicolored image forming.

Since the black-and-white image forming does not require all of the four imaging units, a tandem type multicolored image forming apparatus is constructed to stop rotation of unutilized image holders during black-and-white image forming, to prevent deterioration of unutilized image forming units, in particular, unutilized image holders. This prolongs the life of the image holders, and thereby reduces running costs.

When rotation of image holders which are not involved in image forming is stopped during the black-and-white image forming by the tandem type multicolored image forming apparatus as mentioned above, the image holders whose rotation is stopped should be out of contact with the recording material which is conveyed, to prevent such a situation that a transferred black image is distorted by these image holders whose rotation is stopped. For this purpose, the image holders whose rotation is stopped or a transfer conveyer supporting unit is moved before the black-and-white image forming, to cut the contact between the image holders and the recording material.

To realize both of a non-contact state between the image holders which are not rotated during the black-and-white image forming and the recording material and a contact state between all of the image holders and the recording material during the multicolored image forming, most multicolored image forming apparatuses are constructed to move a transfer material holder unit thereof up and down so as to joint/disjoint the transfer material holder with/from the image holder.

Since the transfer material holder unit is bulky and heavy, extremely large power is needed for a driving unit to move the transfer material holder unit up. However, the transfer material holder unit is seldom moved since the movement is required only when changing an image forming mode from unicolor to multicolor, or from multicolor to unicolor. Consequently, it is uneconomic to use a driving unit having such a large output for seldom required movement of the transfer material holder unit.

BRIEF SUMMARY OF THE INVENTION

The present invention has been made with the aim of solving the above problem, and it is an object thereof to provide a tandem type multicolored image forming apparatus which can effectively utilize a driving unit for jointing/disjointing the transfer material holder with/from the image holder at the time of switching over between a black-and-white image forming mode and a multicolored image forming mode.

A multicolored image forming apparatus according to the present invention comprises: a plurality of image forming units arranged in parallel with each other along a direction in which a recording material is conveyed, each of the image forming units having an image holder; and a junction/disjunction unit for jointing/disjointing a transfer material holder with/from the image holder when switching over between a monochromatic image forming mode which uses a specific image forming unit and a multicolored image forming mode which uses a plurality of image forming units. The multicolored image forming apparatus further comprises an auger for conveying toner, which has been recovered by a transfer material holder cleaning unit for recovering toner remaining on the transfer material holder, into a recovery container, and a driving unit for driving the junction/disjunction unit also drives the auger when switching over between the monochromatic image forming mode and the multicolored image forming mode.

In this structure, the driving unit of the junction/disjunction unit is used not only for jointing/disjointing the transfer material holder with/from the image holder but also for driving the auger to convey the recovered toner. Consequently, a driving force of the driving unit can be effectively utilized, and thereby good cost performance can be realized.

In the multicolored image forming apparatus according to the present invention, the junction/disjunction unit may include: a driving unit; a power transmission part for transmitting a driving force outputted from the driving unit; a cam member for transforming a driving force transmitted by the power transmission part into power for jointing/disjointing the transfer material holder with/from the image holder; and a one-way clutch interposed between the driving unit and the power transmission part. In this case, the junction/disjunction unit transmits power in a selected rotation direction of the driving unit to joint/disjoint the transfer material holder with/from the image holder and to convey toner.

In this structure, the one-way clutch interposed in a driving system between the driving unit and the power transmission part transmits a driving force selectively to the cam member, so that junction/disjunction operation can be performed when needed while the auger for conveying the recovered toner can be rotated in a direction to recover toner without driving the cam member by causing reverse rotation of the driving unit.

In the multicolored image forming apparatus according to the present invention, the driving system of the junction/disjunction unit may have a braking unit for generating a braking force at least when the transfer material holder moves apart from the image holder.

With this structure, wherein a one-way clutch is interposed in the driving system, the braking unit can buffer and control advanced rotation of the cam member due to the gravity of the transfer material holder unit when a unit including the transfer material holder, which is heavy, moves downward (i.e., in a direction in which the transfer material holder moves apart from the image holder). As a result, movement speed of the transfer material holder unit increases, generation of noises (such as noises due to operation and shocks) can be prevented and occurrence of breakage in the transfer material holder unit due to shock which may occur when the unit reaches the lowest position thereof, and accordingly smooth junction/disjunction operation of the transfer material holder can be realized.

The multicolored image forming apparatus according to the present invention may be such constructed that the braking unit generates a braking force when a partial gear of the driving system, which has a series of gear teeth extending around part only of a circumference thereof, is in engagement with a gear provided in the braking unit and does not generate a braking force when the transfer material holder unit moves toward the image holder.

With this structure having a partial gear, a braking force can be generated when the transfer material holder unit moves downward. As a result, generation of noises and shocks due to advanced rotation of the cam member can be prevented while no braking force is generated when the transfer material holder unit moves upward, so that an increase of the load acting on the driving unit does not occur and a large output of the driving unit is therefore not required.

The multicolored image forming apparatus according to the present invention may be such constructed that one tooth of the partial gear is in engagement with the gear of the braking unit when the unit including the transfer material holder is in the lowest position thereof.

When the transfer material holder unit is in the lowest position thereof, the apparatus is in a monochromatic image forming mode. Consequently, in most apparatuses, a monochromatic image forming mode is set as a default image forming mode (the monochromatic image forming is generally performed more often than the multicolored image forming). Accordingly, the multicolored image forming apparatus is mostly waiting in this state, i.e., in such a state that the transfer material holder unit is in the lowest position thereof. With the above-mentioned structure, a braking force can be applied to prevent the transfer material holder unit from being shifted from a set position by an external force (due to vibrations transmitted from other devices or earthquake) or the like, while the braking force can be released as soon as a driving force for moving the unit upward is transmitted.

In the multicolored image forming apparatus according to the present invention, a braking force generated by the braking unit may be set smaller than the gravity of the unit including the transfer material holder acting on the cam member.

When the braking force generated by the braking unit is larger than the gravity, a load acts on the driving unit and a problem arises that requires a high output of the driving unit. However, with the above structure, wherein the braking force generated by the braking unit is set smaller than the gravity of the transfer material holder unit acting on the cam member, no load acts on the driving unit and a high output of the driving unit is therefore not required.

The multicolored image forming apparatus according to the present invention may be of direct transfer type which holds a recording material on a surface of the transfer material holder and directly transfers a toner image formed on the image holder onto the recording material.

With this structure, the effect described above can be obtained by a direct transfer type multicolored image forming apparatus.

The multicolored image forming apparatus according to the present invention may be of indirect transfer type which transfers a toner image formed on the image holder onto the surface of the transfer material holder and then re-transfer the toner image from the transfer material holder onto the conveyed recording material.

With this structure, the effect described above can be obtained by an indirect transfer type multicolored image forming apparatus.

The above and further objects and features of the invention will more fully be apparent from the following detailed description with accompanying drawings.

DETAILED DESCRIPTION OF THE INVENTION

The following description will explain the multicolored image forming apparatus according to an embodiment the present invention in detail with reference to the drawings.

Explanation on Multicolored Image Forming Apparatus

Figure 1:
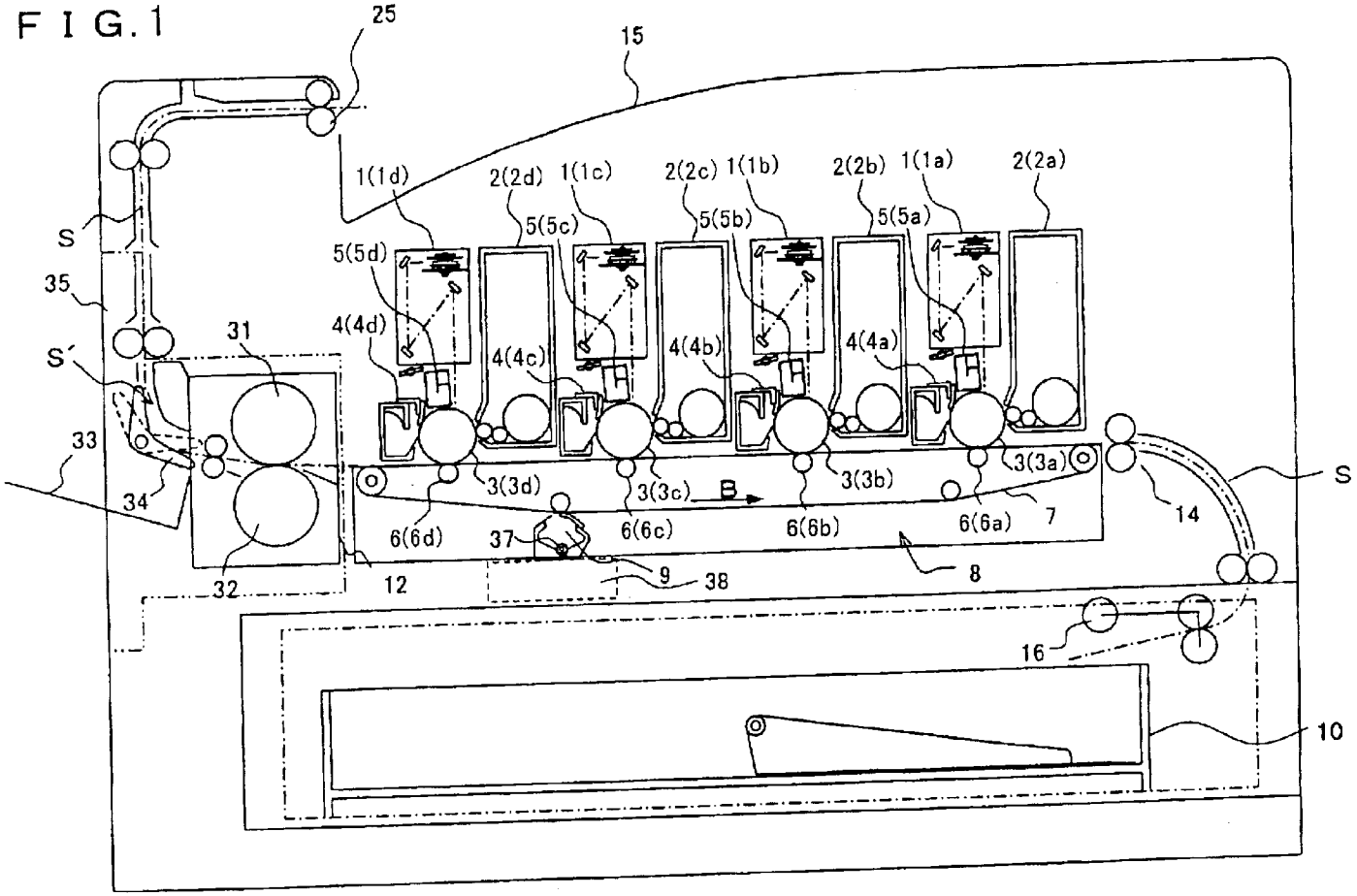
FIG. 1 is an explanatory view for explaining the structure of a multicolored image forming apparatus according to the present invention.

FIG. 1 is an explanatory view for explaining the structure of a multicolored image forming apparatus according to the present invention. This multicolored image forming apparatus forms multicolored or monochromatic images on a predetermined sheet (recording material) based on image data transmitted from the outside. As shown in FIG. 1, the multicolored image forming apparatus comprises: exposure units 1; developing units 2; photoconductor drums (image holders) 3; photoconductor drum cleaning units 4; electrizers 5; a transfer belt unit (unit) 8; a fusing unit 12; a sheet conveyer path S; a paper feed tray 10; copy receiving trays 15 and 33; and the like.

The image data handled by the multicolored image forming apparatus of this embodiment corresponds to multicolored images consisting of black (K), cyan (C), magenta (M) and yellow (Y). Accordingly, four exposure units 1 (1*a*, 1*b*, 1*c*, 1*d*), four developing units 2 (2*a*, 2*b*, 2*c*, 2*d*), four photoconductor drums 3 (3*a*, 3*b*, 3*c*, 3*d*), four photoconductor drum cleaning units 4 (4*a*, 4*b*, 4*c*, 4*d*) and four electrizers 5 (5*a*, 5*b*, 5*c*, 5*d*) are provided respectively to form four kinds of latent images corresponding to respective colors, constructing four image forming units with the elements 1*a* through 5*a* being set for black, the elements 1*b* through 5*b* being set for cyan, the elements 1*c* through 5*c* being set for magenta and the elements 1*d* through 5*d* being set for yellow.

Each photoconductor drum 3 is arranged (attached) in an approximately center portion of the body of the image forming apparatus. An electrizer 5 is means for evenly electrizing the surface of the photoconductor drum 3 to a predetermined electric potential. Used as the electrizer 5 is a contact roller-type or brush-type electrizer, or a charger-type electrizer shown in the FIG. 1.

Each exposure unit 1 is constituted of a writing head of, for example, EL or LED having arrayed luminous elements, or a laser scanning unit (LSU) including a laser irradiation unit and reflecting mirrors as shown in FIG. 1. By exposing an electrized photoconductor drum 3 to light in correspondence with the inputted image data, a latent image corresponding to the image data is formed on the surface of the photoconductor drum 3.

Each developing unit 2 makes the latent image formed on each photoconductor drum 3 visible, with toner of black, cyan, magenta or yellow. The photoconductor drum cleaning unit 4 removes and recovers toner remaining on the surface of the photoconductor drum 3 after developing and transferring an image.

The transfer belt unit 8 which is provided under the photoconductor drum 3 comprises: a transfer belt (transfer material holder) 7; a transfer belt driving roller; a transfer belt tension roller; a plurality of transfer belt driven rollers; transfer rollers 6 (6*a*, 6*b*, 6*c*, 6*d*); and a transfer belt cleaning unit (transfer material holder cleaning unit) 9. The transfer belt cleaning unit 9 is provided with an (spirally formed) auger 37 for conveying toner recovered from the transfer belt 7 into a toner recovery container 36 (see FIG. 2).

The transfer belt driving roller, the transfer belt driven rollers and the transfer belt tension roller suspend the transfer belt 7 and drive the transfer belt 7 to rotate in a direction indicated by the arrow B in FIG. 1. The transfer rollers 6 are rotatably supported on a frame (not illustrated in FIG. 1) inside the transfer belt unit 8, and suspend the transfer belt 7 together with the transfer belt driving roller, the transfer belt driven rollers and the transfer belt tension roller. Each transfer roller 6 transfers a toner image on the photoconductor drum 3 onto a sheet adsorbed on and conveyed by the transfer belt 7.

The transfer belt 7 is provided to be in contact with each photoconductor drum 3. The transfer belt 7 forms a multicolored toner image by successively transferring each toner image of each color formed on each photoconductor drum 3 onto a sheet one upon another. The transfer belt 7 is formed of a film having a thickness of approximately 100 $\mu$m, not to have an edge in the longitudinal direction.

A toner image is transferred from the photoconductor drum 3 onto a sheet by the transfer roller 6 which is in contact with the backside of the transfer belt 7. For transferring a toner image, high voltage (having polarity (+) opposite to the electrification polarity (−) of toner) is applied to the transfer rollers 6. Each transfer roller 6 is mainly made up of a metal (stainless steel, for example) shaft with a diameter of 8 to 10 mm, and the surface thereof is coated with an electrically conductive elastic material (such as EPDM or urethane foam).

This electrically conductive elastic material can apply high voltage on the sheet. Though this embodiment uses a transfer roller 6 as a transfer electrode, other elements such as a brush can be employed.

Since the photoconductor drum 3 is in contact with the transfer belt 7 and toner adhering to the transfer belt 7 may make the rear surface of the sheet dirty, the transfer belt cleaning unit 9 removes and recovers toner.

The paper feed tray 10 which is used for storing a sheet to be used for image forming is provided under the image forming units. The copy receiving tray 15 provided at an upper portion of the body of the image forming apparatus is used for laying a printed sheet face down thereon. The copy receiving tray 33 provided at a side portion of the body of the image forming apparatus is used for laying an image-formed sheet face up thereon.

This multicolored image forming apparatus is provided with a sheet conveyer path S, which is S-formed, for guiding a sheet from the paper feed tray 10 via the transfer belt unit 8 and the fusing unit 12 to the copy receiving tray 15. Furthermore, a pickup roller 16, a resist roller 14, the fusing unit 12, a carry direction switching gate 34, a carrier roller 25 and the like are arranged near the sheet conveyer path S extending from the paper feed tray 10 to the copy receiving tray 15 and copy receiving tray 33.

A plurality of carrier rollers 25, which are small-sized rollers for helping and assisting sheet conveyance, are provided along the sheet conveyer path S. The pickup roller 16 is arranged at an end portion of the paper feed tray 10 to supply a sheet from the paper feed tray 10 to the sheet conveyer path S one by one.

The carry direction switching gate 34 is provided on a side face cover 35 so as to be rotatable. The carry direction switching gate 34 can separate a sheet at the middle of the sheet conveyer path S to guide the sheet to the copy receiving tray 33, when switched over from the state indicated with a continuous line to the state indicated with a dashed line in FIG. 1.

In the state indicated with the continuous line, a sheet is guided along the conveyer path S' (a part of the sheet conveyer path S) formed in a space surrounded by the fusing unit 12, the side face cover 35 and the carry direction switching gate 34, to the copy receiving tray 15 at the upper portion of the apparatus.

The resist roller 14 holds the sheet conveyed along the sheet conveyer path S temporarily. The resist roller 14 then starts conveying the sheet at proper timing adjusted to rotation of the photoconductor drum 3 so as to preferably transfer toner images formed on the photoconductor drums 3 one upon another.

Actually, the resist roller 14 conveys a sheet based on a detection signal outputted from a resist approach detecting switch, which is not illustrated in FIG. 1, to adjust an end of a toner image formed on each photoconductor drum 3 to an end of an image forming range on the sheet.

The fusing unit 12 is provided with a heating roller 31, a pressure roller 32 and the like. The heating roller 31 and the pressure roller 32 are rotated on the opposite sides of the sheet. The temperature of the heating roller 31 is set to be a predetermined fusing temperature by a controller, which is not illustrated in FIG. 1, on the basis of a detected temperature value which is also not illustrated. The heating roller 31 applies thermo compression bonding on the sheet together with the pressure roller 32, to make a multicolored toner image transferred onto the sheet melted, mixed, pressure-welded and then heat-fused onto the sheet.

After the multicolored toner image fusing operation, the sheet is conveyed to the reversed paper carrier path of the sheet conveyer path S by the carrier roller 25, and laid on the copy receiving tray 15 in a reversed manner (i.e., with a multicolored toner image facing downward).

Junction/Disjunction Operation of the Transfer Material Holder

In the above structure, for changing an image forming mode, the transfer belt 7 is jointed/disjointed with/from the rotating photoconductor drums 3 with the photoconductor drum 3 and transfer belt 7 rotating at a constant speed. The rotation of the photoconductor drums 3 is stopped after the transfer belt unit 8 finishes moving downward and the transfer belt 7 is completely disjoined from the photoconductor drums 3 (3*b* to 3*d*).

A junction/disjunction unit 38 for joining/disjoining the transfer belt unit 8 with/from the photoconductor drums 3 is constructed as shown in FIGS. 2 through 5. The junction/disjunction unit 38 is composed of: a driving unit (junction/disjunction driving motor) 39; a power transmission gear part (power transmission part) 40 for transmitting a driving force outputted from the driving unit 39; and cam gears (cam member) 41, which are driven by the power transmission gear part 40 to rotate, having cam portions 43 which rub against the bottom of supporting members 50 supported under both sides of the downstream side portion of the transfer belt unit 8.

The power transmission gear part 40 is attached to a frame member 49 which is provided at one side of the body of the image forming apparatus. The power transmission gear part 40 is composed of: a driving gear 44 fixed at an output shaft of the driving unit 39; an intermediate gear 45 engaged with the driving gear 44; and a driven gear 46 engaged with the intermediate gear 45. It should be understood that a wrapping connector mechanism having a belt, a pulley and the like may be employed instead of the power transmission gear part 40.

The driven gear 46 is fitted on the rotary shaft 48 via a one-way clutch 47. The rotary shaft 48 is rotatably supported on frame members 49 of the body of the image forming apparatus at both ends thereof. A couple of cam gears 41 are fixed inside the frame members 49 of the rotary shaft 48.

Figure 2:
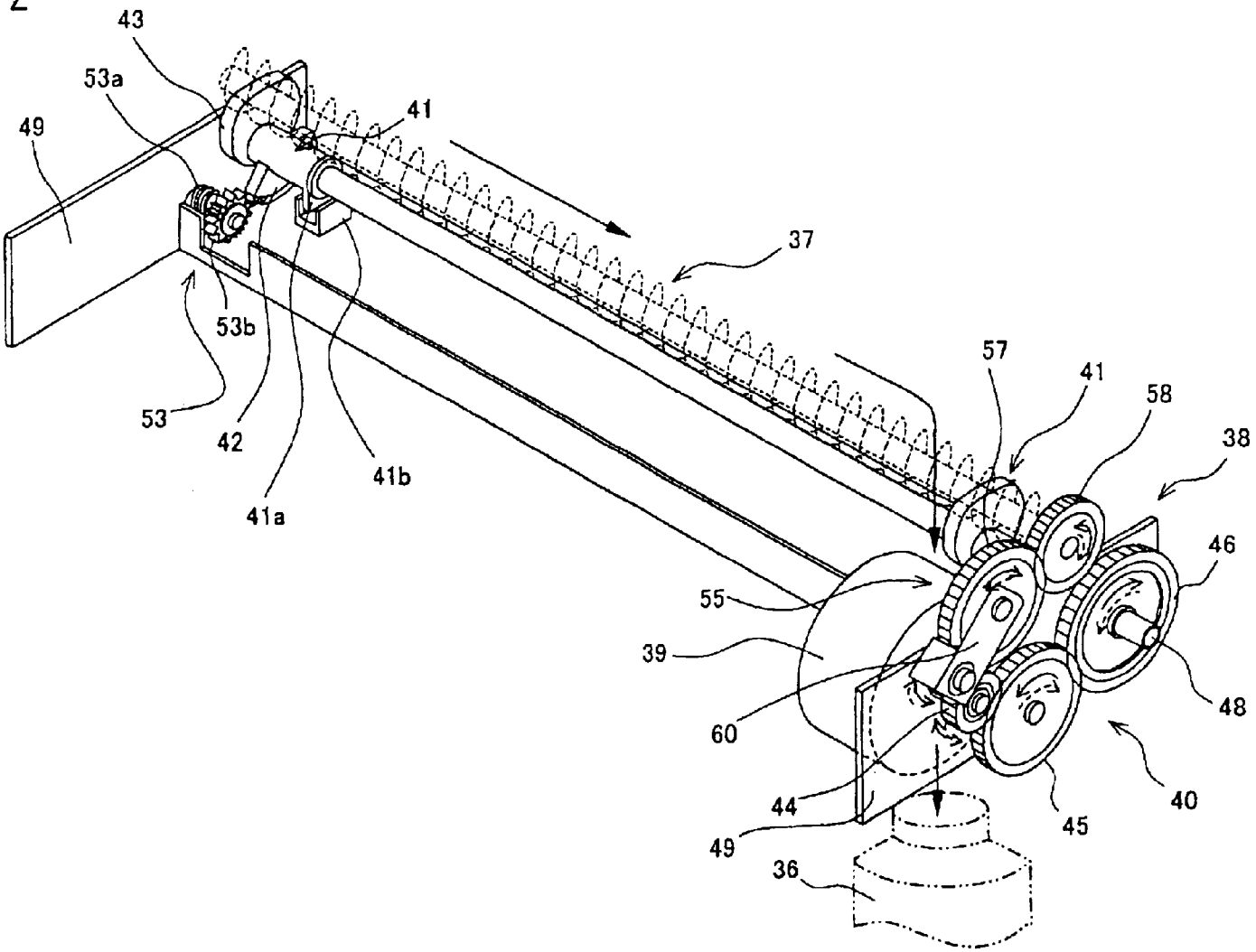
FIG. 2 is a perspective view illustrating the main part of the multicolored image forming apparatus.
Figure 4:
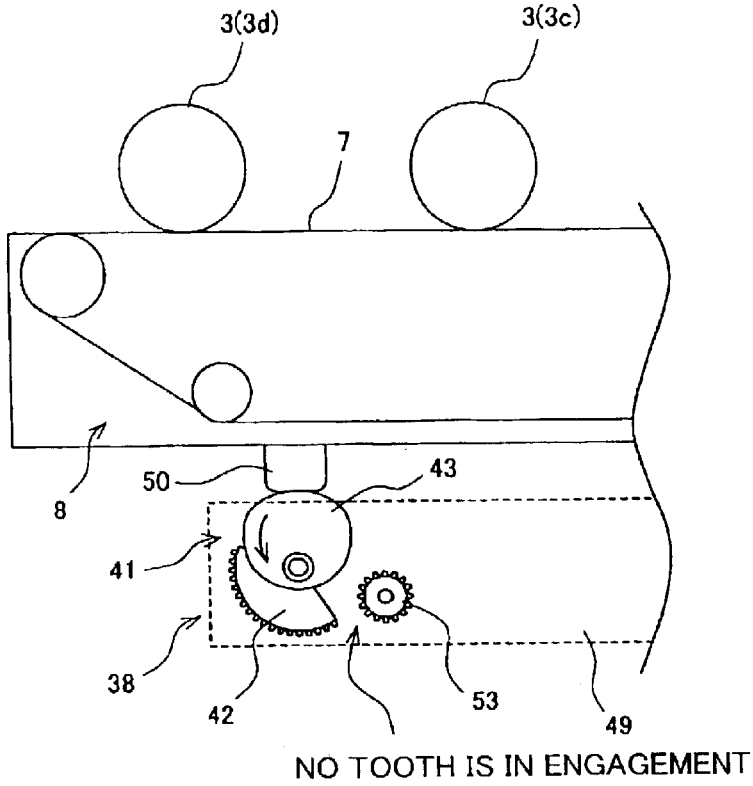
FIG. 4 is an explanatory view illustrating a state where the transfer material holder is in the highest position thereof.
Figure 5:
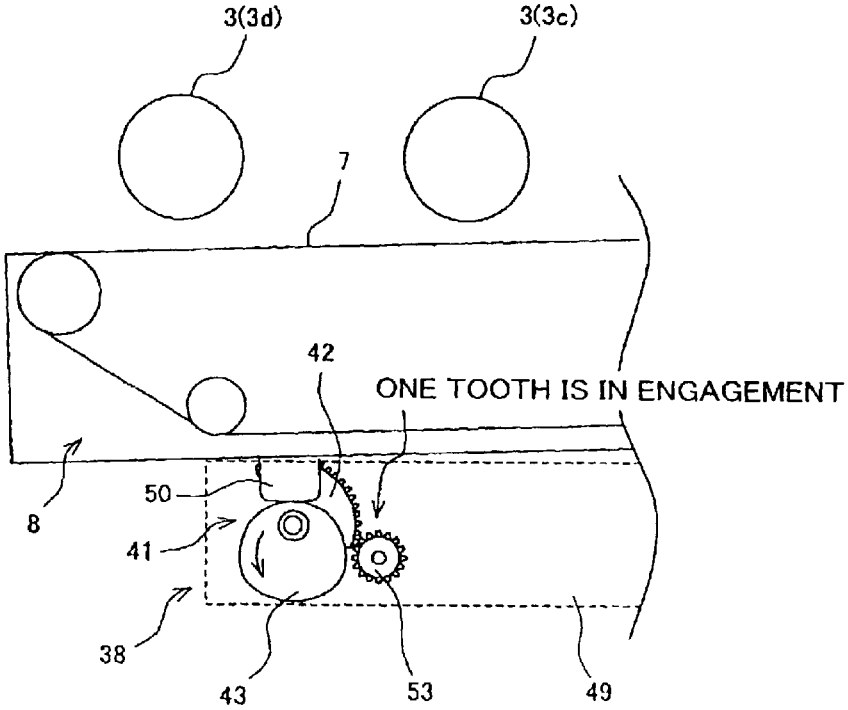
FIG. 5 is an explanatory view illustrating a state where the transfer material holder is in the lowest position thereof.

The cam gear 41 is formed of a resin such as self-lubricative polyacetal. As shown in FIGS. 4 and 5, the cam gear 41 has a partial gear 42 in a sector form, which has a series of gear teeth extending around part only of the circumference thereof, and a cam portion 43 which are integrally formed. A torque limiter (braking unit) 53 to be engaged with the partial gear 42 is provided on one of the frame members 49. The cam portions 43 rub against the bottom of the supporting members 50 which are projected downward from both sides of the downstream side portion of the transfer belt unit 8. As shown in FIG. 2, a sensor blade 41*a* is integrally formed on a cam gear 41 which is arranged at the side where the torque limiter 53 is provided, so that a detector 41*b* provided on the body of the image forming apparatus detects a positional state thereof.

The above-mentioned torque limiter 53 (see FIG. 2) is composed of: two washers, such as flat washers (polysliders) made of a resin, which can slide preferably; a compression spring 53*a* and a brake gear (gear) 53*b* interposed between the two washers; and the like. The torque limiter 53 buffers and controls downward movement of the transfer belt unit 8 and holds the transfer belt unit 8 in a stable manner in the lowest position thereof.

Figure 3:
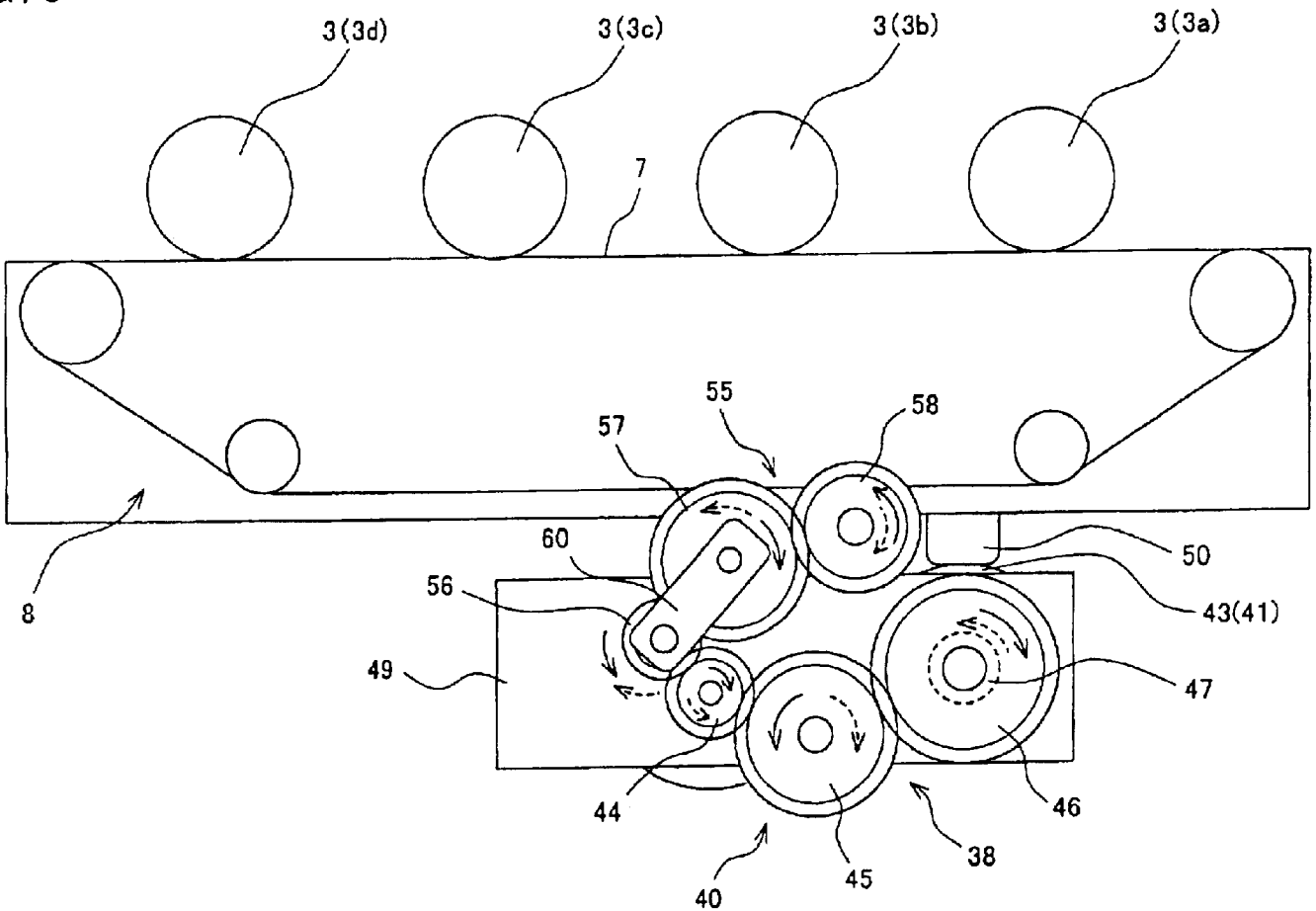
FIG. 3 is an explanatory view for explaining the essential structure of the multicolored image forming apparatus.

The load torque acting on the rotary shaft 48 of the cam gear 41 is 6.5 kgfcm. The braking force of the torque limiter 53 is set to be 1.2 to 1.6 kg at the rotary shaft 48 of the cam gear 41. The braking force is set to a relatively small value to prevent a braking force from acting on the driving unit 39. Upon this setting, rotation of the driven gear 46 in a direction indicated with the arrow of continuous line in FIG. 3 is permitted by the one-way clutch 47, so that the cam gear 41 rotates slightly ahead of the rotation of the driving unit 39 by the load acting on the cam portion 43.

With such a structure, as shown in FIG. 4, the transfer belt unit 8 which has been in contact with all of the photoconductor drums 3 (3*a* through 3*d*) in an upper position thereof (i.e., in a multicolored image forming mode) is shifted to a state shown in FIG. 5 having a downstream side portion thereof moved downward, when regular rotation (in a direction indicated by the arrow of continuous line) of the driving unit 39 rotates the cam gear 41 over 180 degrees. In this state, the transfer belt unit 8 is positioned apart from the photoconductor drums 3*b* through 3*d* (which is the monochromatic image forming mode wherein only the photoconductor drum 3*a* is in contact with the transfer belt unit 8).

In this state, where the partial gear 42 of the cam gear 41 is in engagement with the brake gear 53*b* of the torque limiter 53, a braking force acts and the advance rotation of the cam gear 41 is buffered and controlled. As a result, the downward movement of the transfer belt unit 8 is buffered and the transfer belt unit 8 is smoothly guided into the lowest position thereof.

When the transfer belt unit 8 is in the lowest position thereof, only one tooth of the partial gear 42 engages with the brake gear 53*b* of the torque limiter 53 and a braking force acts so as to prevent the transfer belt 7 from being drifted improperly in the default state (i.e., in a monochromatic image forming mode) of the transfer belt unit 8, so that the transfer belt 7 is held in a stable manner.

The apparatus is such constructed that the load of the transfer belt unit 8 is directed toward the rotational center of the cam gear 41 (vertically downward). Consequently, even when the cam portion 43 of the cam gear 41 is in the highest position thereof (a multicolored image forming mode), no force making the cam gear 41 to rotate is generated by the load of the transfer belt unit 8, so that the transfer belt unit 8 is held in a stable manner.

It should be noted that, when employing a stepping motor as the driving unit 39 for junction/disjunction operation of the transfer belt unit 8 and as a driving source for rolling the photoconductor drum 3 and the transfer belt 7, the control of the speed and position can be performed in an open-loop manner with high accuracy and timing of each operation can be controlled easily and appropriately.

In particular, in this embodiment, a driving force outputted from the driving unit 39 is transmitted via another gear combination 55 to the auger 37, so that toner recovered from the transfer belt 7 can be conveyed and recovered into the toner recovery container 36. The gear combination 55 is composed of: a power transmission gear 56 engaged with the driving gear 44 of the driving, unit 39; an intermediate gear 57 engaged with the power transmission gear 56; and a driven gear 58 which is attached at one end of the auger 37. The power transmission gear 56 and the intermediate gear 57 are supported by a movable connecting arm 60 supported on the frame member 49, and are always biased in the engagement direction by biasing means (not illustrated in the figures). With this structure, the engagement state between the driven gear 58 moving up and down with the upward and downward movement of the transfer belt unit 8 and the intermediate gear 57 can be ensured.

The load acting on each cam portion 43 of each cam gear 41 is 5 kgf, wherein the cam portions 43 of the right and left cam gears 41 are supporting the load of 10 kgf in total by the transfer belt unit 8 sharing the burden with each other. It should be understood that, though this embodiment uses a partial gear 42 of a cam gear 41 having teeth over 150 degrees, the value can be modified in a suitable manner in accordance with design conditions.

With the above structure, for moving the transfer belt unit 8 downward, a driving force outputted from the driving unit 39 rotating clockwise in FIG. 3 rotates the driven gear 58 counterclockwise by the driving gear 44, rotates the auger 37 integrally formed with the driven gear 58 in the same direction, and conveys and recovers toner which has been recovered from the transfer belt 7 into the toner recovery container 36. In other words, the invention uses the driving force outputted from the driving unit 39 also as a driving force for rotating the auger 37, so as to realize effective utilization.

Toner remaining on the transfer belt 7 includes: toner which has adhered through generation of trouble in a jam in conveying a sheet or the like; toner used for patch images which has been directly transferred from the photoconductor drums 3 onto the transfer belt 7 for the purpose of image forming process control required for maintaining the image quality; toner which has been hanging in the air inside the multicolored image forming apparatus and then adhered to the transfer belt 7; and, the like. By removing toner in appropriate timing as described above (at the time of changing the image forming mode), stable image quality can be ensured.

It should be understood that, though this, embodiment conveys toner in the axial direction since the auger 37 is configured as a helical member, the invention may be constructed to scrape toner out in a direction crossing the axial direction at a right angle, by attaching a blade to the auger 37 in the axial direction. In this case, the auger 37 may be configured simply as a square member or the like.

During the junction/disjunction operation of the transfer belt unit 8, the auger 37 is rotated in the reverse direction. This embodiment is structured to allow this reverse rotation of the auger 37 since the reverse rotation is performed infrequently and for a short time. However, in case where the reverse rotation of the auger 37 becomes a problem, the driven gear 58 may be attached to the rotary shaft 48 of the auger 37 via a one-way clutch.

As described above, the driving unit 39 of the junction/disjunction unit 38 is used not only for jointing/disjointing the transfer material holder 7(8) with/from the image holder 3 but also for driving the auger 37 to convey the recovered toner. Accordingly, a driving force outputted from the driving unit 39 can be effectively utilized, and thereby good cost performance can be realized.

Though the above embodiment explains a direct transfer type multicolored image forming apparatus for directly transferring an image from the photoconductor 3 onto a sheet, the same effect can be obtained by employing the structure of the junction/disjunction unit 38 for also driving the auger 37 as shown in FIGS. 2 through 5 for an indirect transfer type multicolored image forming apparatus using an intermediate transfer belt as a transfer material holder.

With an indirect transfer type multicolored image forming apparatus, a toner image formed on an image holder (photoconductor drum) is temporarily transferred onto the intermediate transfer belt, and then re-transferred from the intermediate transfer belt onto a conveyed sheet. In this case, the intermediate transfer belt is also positioned apart from the image holder in a monochromatic image forming mode. Consequently, a junction/disjunction unit 38 as described in the above embodiment may be provided so that a driving force outputted from a driving unit 39 can be transmitted to an auger 37 via another gear combination 55 and toner which has been recovered from the intermediate transfer belt can be conveyed and recovered into a toner recovery container 36. Figures illustrating the structure are omitted here.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A multicolored image forming apparatus comprising:

a plurality of image forming units arranged in parallel with each other along a direction in which a recording material is conveyed, each of the image forming units having an image holder;

a transfer material holder cleaning unit for recovering toner remaining on a transfer material holder;

an auger for conveying toner, which has been recovered by the transfer material holder cleaning unit, into a recovery container; and a junction/disjunction unit for jointing/disjointing the transfer material holder with/from the image holder when switching over between a monochromatic image forming mode which uses a specific image forming unit and a multicolored image forming mode which uses a plurality of image forming units, the junction/disjunction unit including a driving unit for driving the junction/disjunction unit and the auger when switching over between the monochromatic image forming mode and the multicolored image forming mode.

2. The multicolored image forming apparatus according to claim 1, wherein the junction/disjunction unit further comprises:

a power transmission part for transmitting a driving force outputted from the driving unit;

a cam member for transforming a driving force transmitted by the power transmission part into power for jointing/disjointing the transfer material holder with/from the image holder; and a one-way clutch interposed between the driving unit and the power transmission part, and the junction/disjunction unit transmits power in a selected rotation direction of the driving unit to joint/disjoint the transfer material holder with/from the image holder and to convey toner.

3. The multicolored image forming apparatus according to claim 1, which is of direct transfer type that holds a recording material on a surface of the transfer material holder and directly transfers a toner image formed on the image holder onto the recording material.

4. The multicolored image forming apparatus according to claim 1, which is of indirect transfer type that transfers a toner image formed on the image holder onto a surface of the transfer material holder and then re-transfers the toner image from the transfer material holder onto a conveyed recording material.

5. The multicolored image forming apparatus according to claim 2, wherein the junction/disjunction unit further comprises a driving system, the driving system including a braking unit for generating a braking force at least when the transfer material holder moves apart from the image holder.

6. The multicolored image forming apparatus according to claim 2, which is of direct transfer type that holds a recording material on a surface of the transfer material holder and directly transfers a toner image formed on the image holder onto the recording material.

7. The multicolored image forming apparatus according to claim 2, which, is of indirect transfer type that transfers a toner image formed on the image holder onto a surface of the transfer material holder and then re-transfers the toner image from the transfer material holder onto a conveyed recording material.

8. The multicolored image forming apparatus according to claim 5, wherein the driving system further includes a partial gear, which has a series of gear teeth extending around part only of the circumference thereof, the braking unit includes a gear, and the braking unit generates a braking force when the partial gear of the driving system is in an engagement with the gear of the braking unit, and does riot generate a braking force when the transfer material holder moves toward the image holder.

9. The multicolored image forming apparatus according to claim 5, wherein a braking force generated by the braking unit is smaller than a force of gravity of the unit including the transfer material holder acting on the cam member.

10. The multicolored image forming apparatus according to claim 9, which is of direct transfer type that holds a recording material on a surface of the transfer material holder and directly transfers a toner image formed on the image holder onto the recording material.

11. The multicolored image forming apparatus according to claim 9, which is of indirect transfer type that transfers a toner image formed on the image holder onto a surface of the transfer material holder and then re-transfers the toner image from the transfer material holder onto a conveyed recording material.

12. The multicolored image forming apparatus according to claim 5, which is of direct transfer type that holds a recording material on a surface of the transfer material holder and directly transfers a toner image formed on the image holder onto the recording material.

13. The multicolored image forming apparatus according to claim 5, which is of indirect transfer type that transfers a toner image formed on the image holder onto a surface of the transfer material holder and then re-transfers the toner image from the transfer material holder onto a conveyed recording material.

14. The multicolored image forming apparatus according to claim 8, wherein one tooth of the partial gear is in the engagement with the gear of the braking unit when a unit including the transfer material holder is in the lowest position thereof.

15. The multicolored image forming apparatus according to claim 8, wherein a braking force generated by the braking unit is smaller than a force of gravity of the unit including the transfer material holder acting on the cam member.

16. The multicolored image forming apparatus according to claim 8, which as of direct transfer type that holds a recording material on a surface of the transfer material holder and directly transfers a toner image formed on the image holder onto the recording material.

17. The multicolored image forming apparatus according to claim 8, which is of indirect transfer type that transfers a toner image formed on the image holder onto a surface of the transfer material holder and then re-transfers the toner image from the transfer material, holder onto a conveyed recording material.

18. The multicolored image forming apparatus according to claim 14, wherein a braking force generated by the braking unit is smaller than a force of gravity of the unit including the transfer material holder acting on the cam member.

19. The multicolored image forming apparatus according to claim 14, which is of direct transfer type that holds a recording material on a surface of the transfer material holder and directly transfers a toner image formed on the image holder onto the recording material.

20. The multicolored image forming apparatus according to claim 14, which is of indirect transfer type that transfers a toner image formed on the image holder onto a surface of the transfer material holder and then re-transfers the toner image from the transfer material holder onto a conveyed recording material.

* * * * *